US008334654B2

(12) United States Patent
Kikuchi et al.

(10) Patent No.: US 8,334,654 B2
(45) Date of Patent: Dec. 18, 2012

(54) DISCHARGE LAMP, CONNECTING CABLE, LIGHT SOURCE APPARATUS, AND EXPOSURE APPARATUS

(75) Inventors: Takayuki Kikuchi, Zushi (JP); Hiroshi Kitano, Kawasaki (JP)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 12/576,921

(22) Filed: Oct. 9, 2009

(65) Prior Publication Data

US 2010/0118287 A1 May 13, 2010

Related U.S. Application Data

(63) Continuation of application No. PCT/JP2008/056719, filed on Apr. 3, 2008.

(60) Provisional application No. 60/907,656, filed on Apr. 12, 2007.

(51) Int. Cl.
*H01J 17/04* (2006.01)

(52) U.S. Cl. ..... 313/623; 313/113

(58) Field of Classification Search ..... 313/623, 313/22, 113, 635

See application file for complete search history.

(56) References Cited

U.S. PATENT DOCUMENTS

| | | | | |
|---|---|---|---|---|
| 3,843,879 A | | 10/1974 | Eddy | |
| 4,433,265 A | * | 2/1984 | Fischer et al. | 313/22 |
| 4,785,216 A | * | 11/1988 | Roberts et al. | 313/32 |
| 5,493,168 A | | 2/1996 | Seedorf | |
| 5,633,556 A | * | 5/1997 | Fujina et al. | 313/32 |
| 6,087,764 A | * | 7/2000 | Matei | 313/22 |
| 6,369,876 B1 | * | 4/2002 | Sato | 355/69 |
| 6,771,353 B2 | | 8/2004 | Sato | |
| 6,778,257 B2 | | 8/2004 | Bleeker et al. | |
| 6,949,881 B2 | * | 9/2005 | Inaoka et al. | 313/635 |
| 2001/0010447 A1 | * | 8/2001 | Yamane et al. | 313/113 |

FOREIGN PATENT DOCUMENTS

| | | |
|---|---|---|
| EP | 0947883 | 10/1999 |
| EP | 0947883 | 12/1999 |
| JP | 3-64811 | 3/1991 |
| JP | 4-32154 | 2/1992 |
| JP | 9-213129 | 8/1997 |

(Continued)

OTHER PUBLICATIONS

European Patent Office Search Report, issued Apr. 6, 2011, in corresponding European Patent Application 08739826, 6 pages.

(Continued)

*Primary Examiner* — Nimeshkumar Patel
*Assistant Examiner* — Mary Ellen Bowman
(74) *Attorney, Agent, or Firm* — Finnegan, Henderson, Farabow, Garrett & Dunner, L.L.P.

(57) ABSTRACT

A light source device having a large cooling action on the base member of a discharge lamp. A connector on the sides of the power supply and the air blower and the base-side connector of a discharge lamp are connected to each other through a connection cable having a power cable in which an air blow pipe is contained. An electric power is supplied from the power supply to a base part through the power cable of the connection cable, the base-side connector and a flow passage bending member. The cool air from the air blower is supplied to the groove part of the base part through the air blow pipe of the connection cable, the base-side connector and an air blow passage in the flow passage-bending member.

18 Claims, 7 Drawing Sheets

FOREIGN PATENT DOCUMENTS

| | | | |
|---|---|---|---|
| JP | 63-160192 | | 7/1998 |
| JP | 11-283898 | | 10/1999 |
| WO | WO-99/49504 | | 9/1999 |
| WO | WO 00/60643 | | 10/2000 |
| WO | WO-2004/019128 | A2 | 3/2004 |

OTHER PUBLICATIONS

Singapore Search Report, issued Nov. 3, 2010, in corresponding Singapore Patent Application 200906773-7, 17 pages.

International Search Report, issued May 13, 2008, in corresponding International application No. PCT/JP2008/056719, 4 pages.

Written Opinion of the International Searching Authority, issued May 13, 2008, in corresponding International application No. PCT/JP2008/056719, 9 pages.

Office Action from the State Intellectual Property Office of People's Republic of China, issued Dec. 6, 2010, in corresponding Chinese application 200880000911.7, 16 pages.

Singapore Examination Report, issued Jun. 6, 2011, in corresponding Singapore Patent application 200906773-7.

Notification of Reasons for Refusal, issued Apr. 25, 2012 with English language translation from the Japanese Patent Office in corresponding Japanese Patent Application No. 2008-097607.

EP Communication, Office Action in application EP 08739826.9 mailed Jul. 16, 2012.

European Patent Office Search Report, issued Apr. 7, 2011, in corresponding European Patent Application 08739826, 6 pages.

Singapore Examination Report, issued Jul. 6, 2011, in corresponding Singapore Patent application 200906773-7.

Notification of Reasons for Refusal, issued May 2, 2012 with English language translation from the Japanese Patent Office in corresponding Japanese Patent Application No. 2008-097607.

* cited by examiner

DISCHARGE LAMP, CONNECTING CABLE, LIGHT SOURCE APPARATUS, AND EXPOSURE APPARATUS

CROSS-REFERENCE TO RELATED APPLICATION

This is a Continuation Application of International Application No. PCT/JP2008/056719, filed Apr. 3, 2008, which claims priority to U.S. Provisional Application No. 60/907,656, filed Apr. 12, 2007. The contents of the aforementioned applications are incorporated herein by reference.

BACKGROUND

1. Field of the Invention

The present invention relates to a discharge lamp, a connecting cable that is used when connecting a discharge lamp and a power supply, a light source apparatus that is provided with a discharge lamp, and an exposure apparatus that is provided with this light source apparatus.

2. Description of Related Art

An exposure apparatus, such as a full field exposure type (stationary exposure type) projection exposure apparatus (e.g., a stepper) or a scanning exposure type projection exposure apparatus (e.g., a scanning stepper) that transfers a pattern formed on a reticle (or a photomask and the like) to a wafer (or a glass plate and the like) that is coated with a resist, is used in a lithographic process for fabricating various devices (such as microdevices and electronic devices). An exposure light source apparatus that comprises a combination of a discharge lamp, such as a mercury lamp, and a condenser mirror is used in such an exposure apparatus, and that discharge lamp is held via a prescribed mounting mechanism.

Among conventional light source apparatuses that have a discharge lamp, there is a type that is provided with a cooling mechanism for reducing the effects of heat generation. In one example of a conventional cooling mechanism, cooled air is supplied from an outer surface of one base of the discharge lamp toward an outer surface of another base via an outer surface of a bulb part (e.g., refer to Japanese Patent Application, Publication No. H09-213129). In another example of a known conventional cooling mechanism, a ring-shaped groove part is provided on a base of a discharge lamp, and cooled air is supplied to a bulb part via the groove part and a prescribed air-blowing pipe (e.g., refer to Japanese Patent Application, Publication No. H11-283898).

With the discharge lamp cooling mechanism in the conventional light source apparatus, cool air is blown principally against the bulb part of the discharge lamp, and consequently there is a problem in that the cooling action with respect to the base is small. Also, the discharge lamp has a base on the fixed side and a base on the free end side, and in the case of cooling the base on the free end side using a conventional cooling mechanism, it is necessary to install piping for air blowing and the like around the base, and consequently there is the problem of much of the light from the discharge lamp being blocked.

SUMMARY

A purpose of some aspects of the invention is to provide a light source apparatus in which the cooling action on the base member of the discharge lamp is large, and the amount of blocked light is small with respect to the light that is generated from the discharge lamp when cooling the base on the free-end side.

Another purpose is to provide a discharge lamp and a connecting cable that can be adapted to such a light source apparatus, and exposure technology wherein that light source apparatus is used.

A discharge lamp in an aspect according to the present invention is a discharge lamp that houses electrodes for electric discharge in a glass member, consisting of: a base member that is coupled to the glass member; a relay member that is provided in the base member and is formed with an electrically conductive material; a coupling member that has an electrically conductive member that is electrically connected with the relay member; and a flow path that is provided in the relay member and the coupling member for supplying a cooling medium to the base member.

Also, a connecting cable according to the present invention is a connecting cable for coupling an apparatus that uses a cooling medium and electric power and a supply source of the cooling medium and a power supply, consisting of a tubular member that is formed with a flexible material and that has a flow path for the cooling medium; and a covering member that is formed with a flexible material that has electrical conductivity and provided so as to cover the tubular member.

A light source apparatus in an aspect according to the present invention is a light source apparatus that is connected to a power supply and a supply source of a cooling medium, consisting of the discharge lamp of the present invention; and the connecting cable of the present invention for connecting the power supply and the supply source, and the discharge lamp.

An exposure apparatus in an aspect according to the present invention is an exposure apparatus that exposes a pattern on a photosensitive substrate using exposure light that is generated from a light source apparatus, characterized by using the light source apparatus of the present invention as the light source apparatus.

Figure 1:
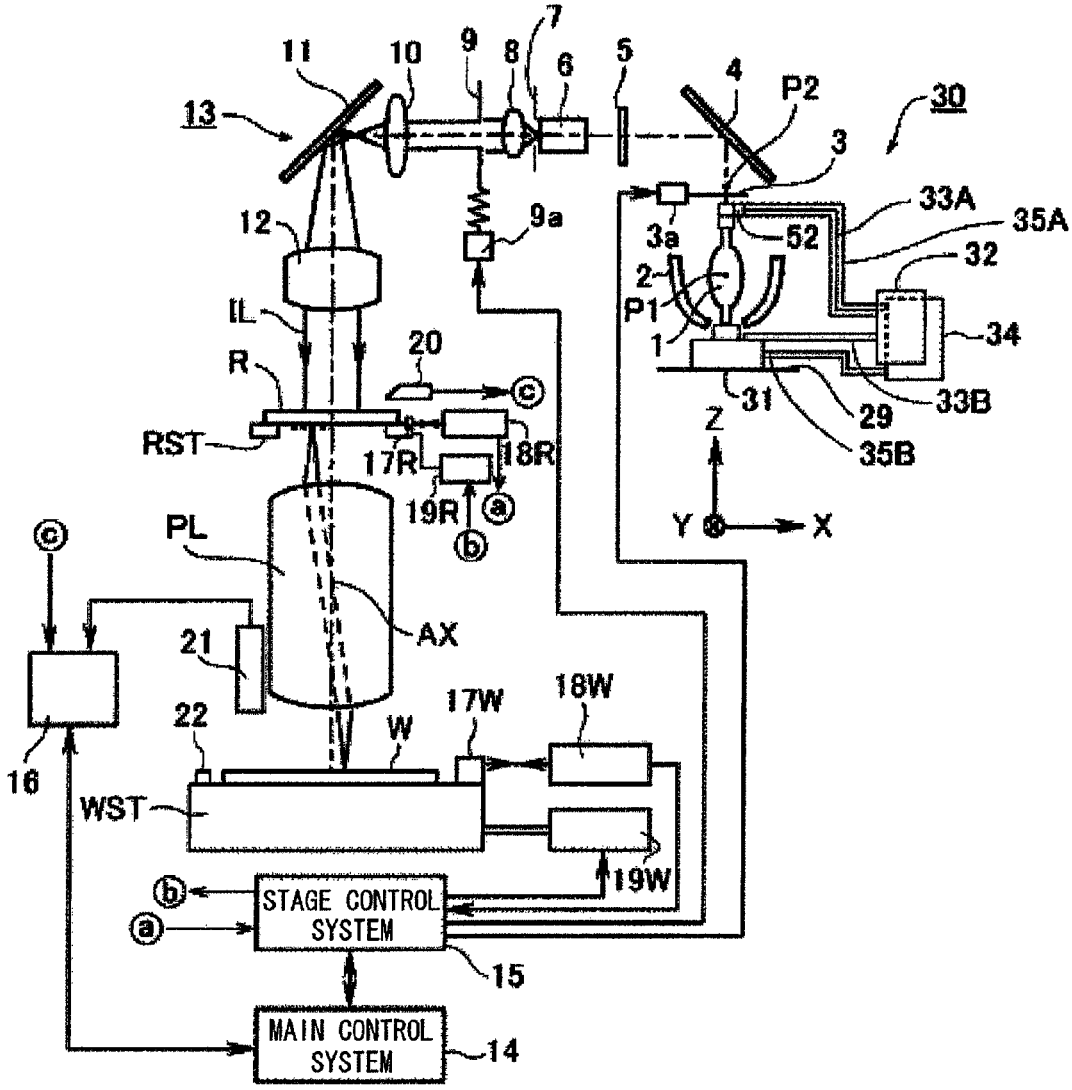
FIG. 1 is a schematic block diagram of a projection exposure apparatus according to one embodiment.
Figure 2:
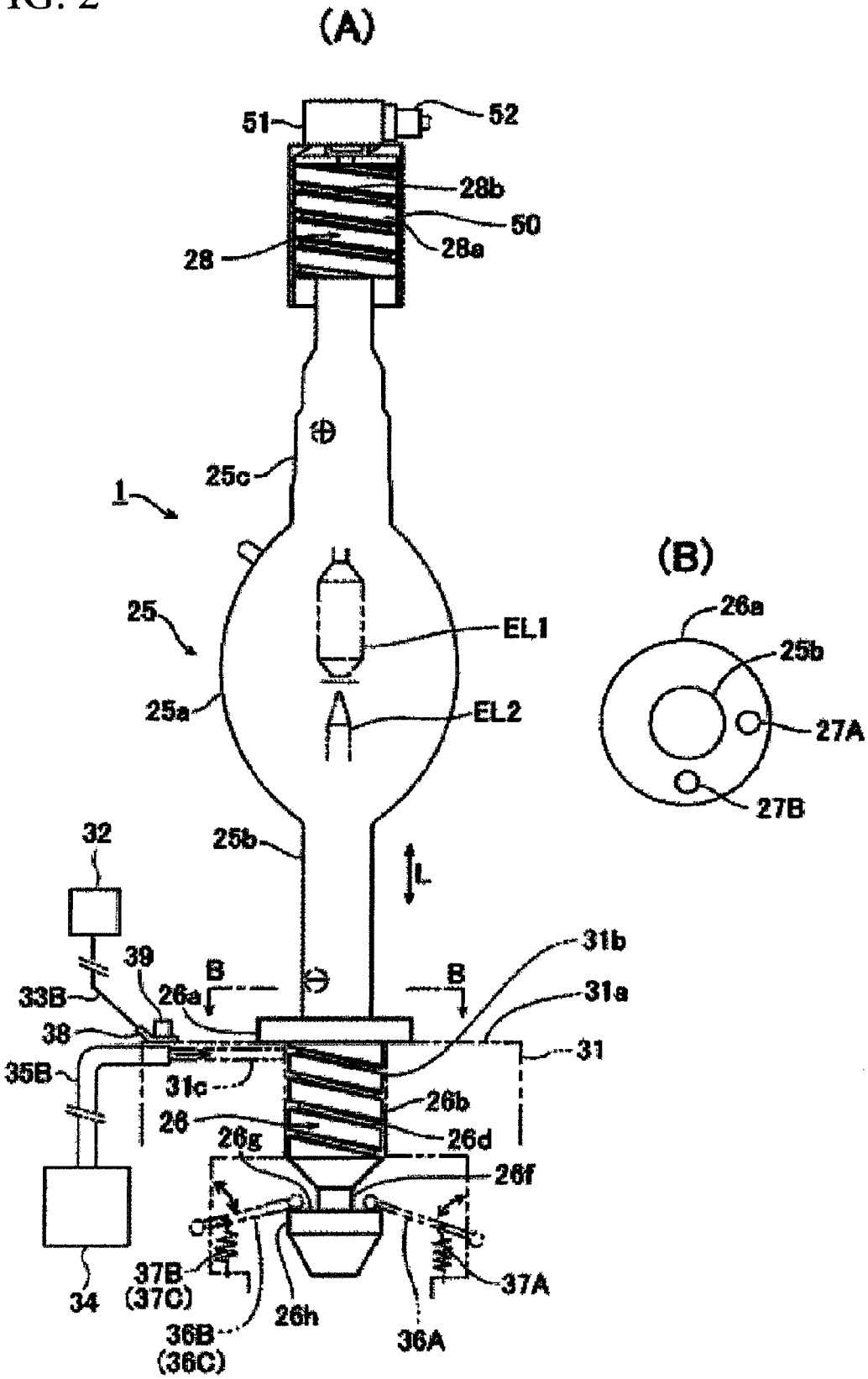

Part (A) of FIG. 2 is a partial cutaway view that shows the discharge lamp in FIG. 1, and part (B) of FIG. 2 is a cross-sectional view taken along line B-B in part (A) of FIG. 2.

Figure 3:
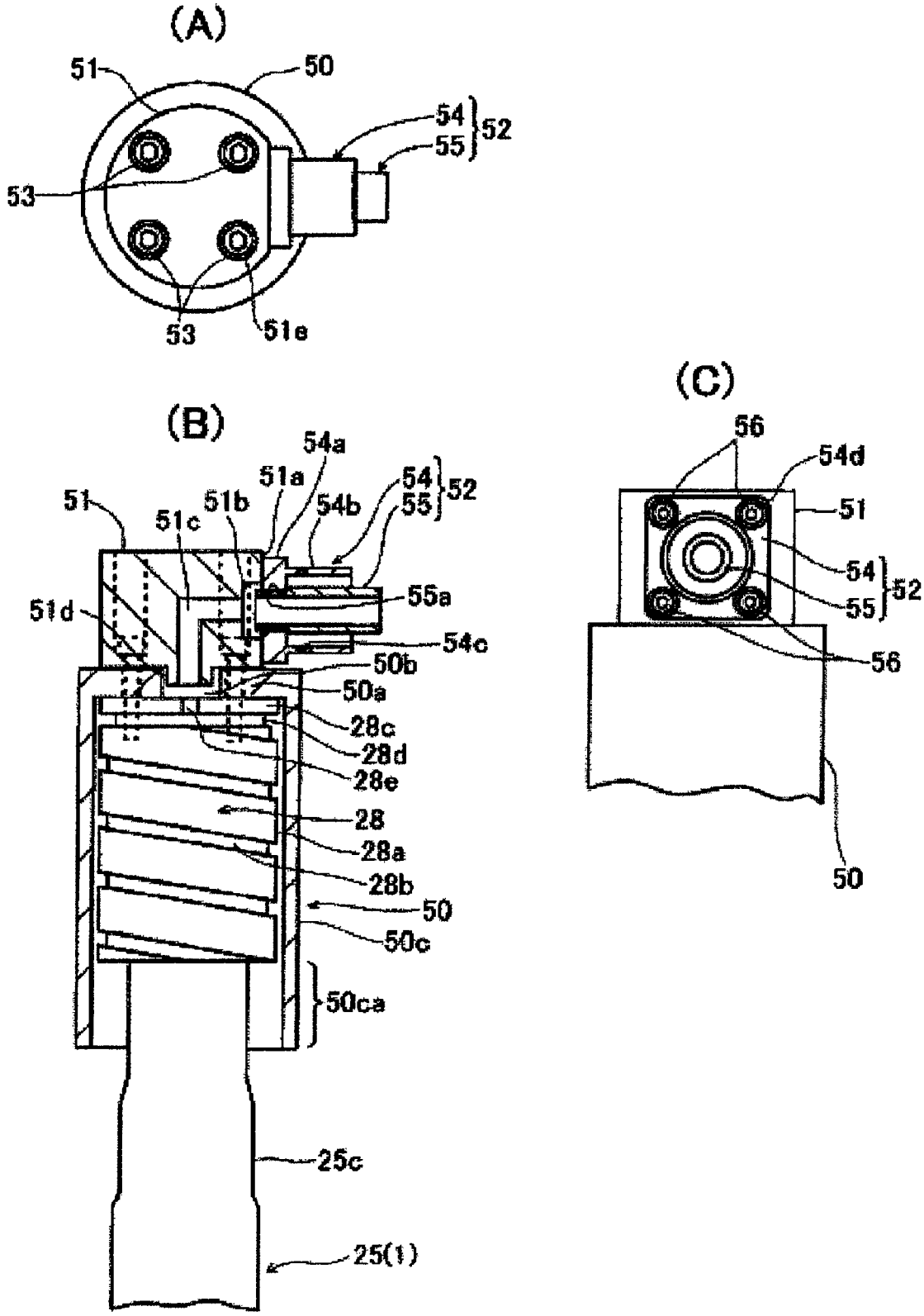

Part (A) of FIG. 3 is a plan view that shows the flow path bending member 51 and the base-side connector 52 on the base part 28 side of part (A) of FIG. 2, part (B) of FIG. 3 is a cross-sectional view that shows the constitution in the vicinity of the base part 28 of part (A) of FIG. 2, and part (C) of FIG. 3 is a side view of the principal parts of part (B) of FIG. 3.

Figure 4:
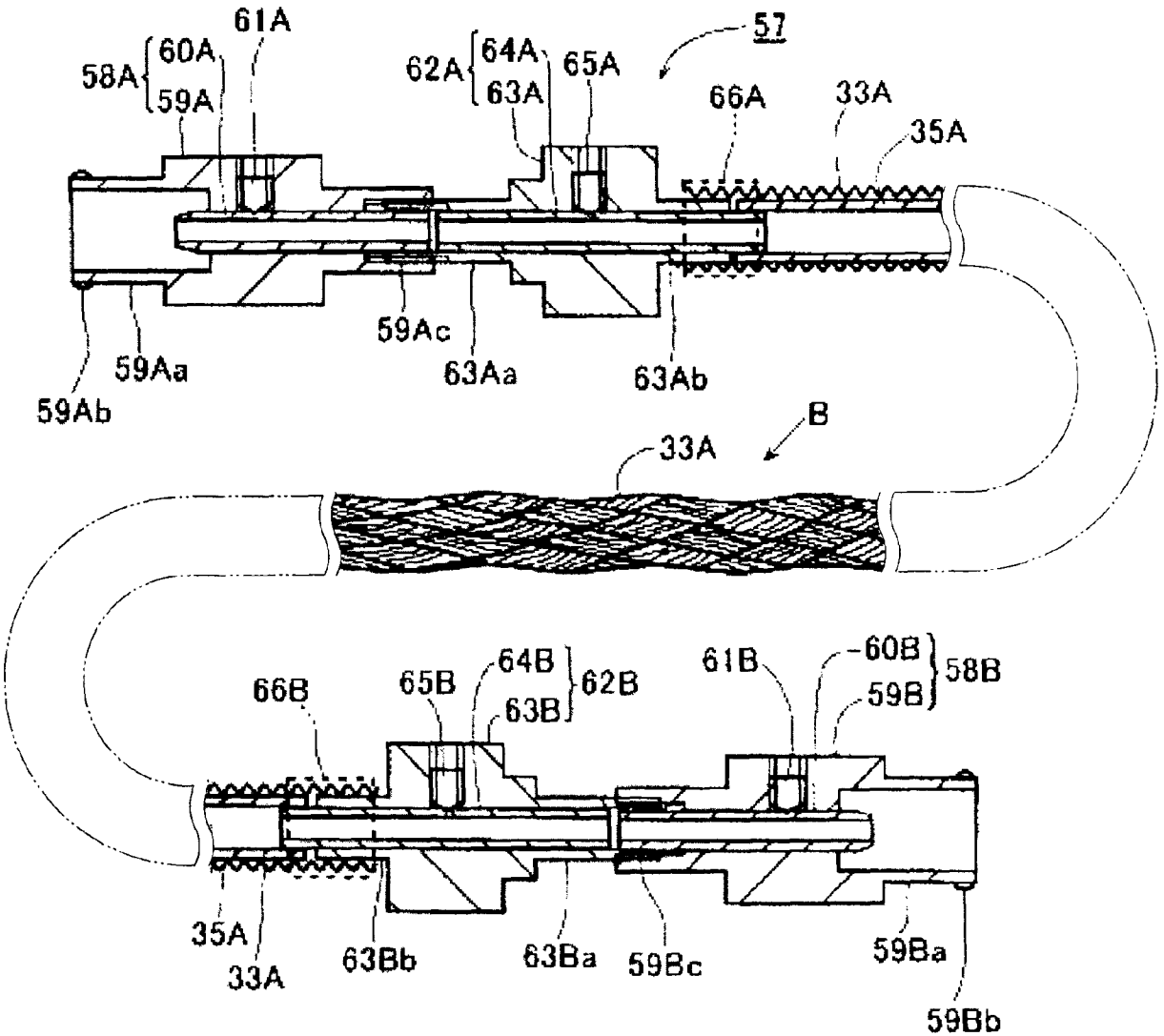

FIG. 4 is a partial cutaway view that shows the coupling cable 57 according to one embodiment.

Figure 5:
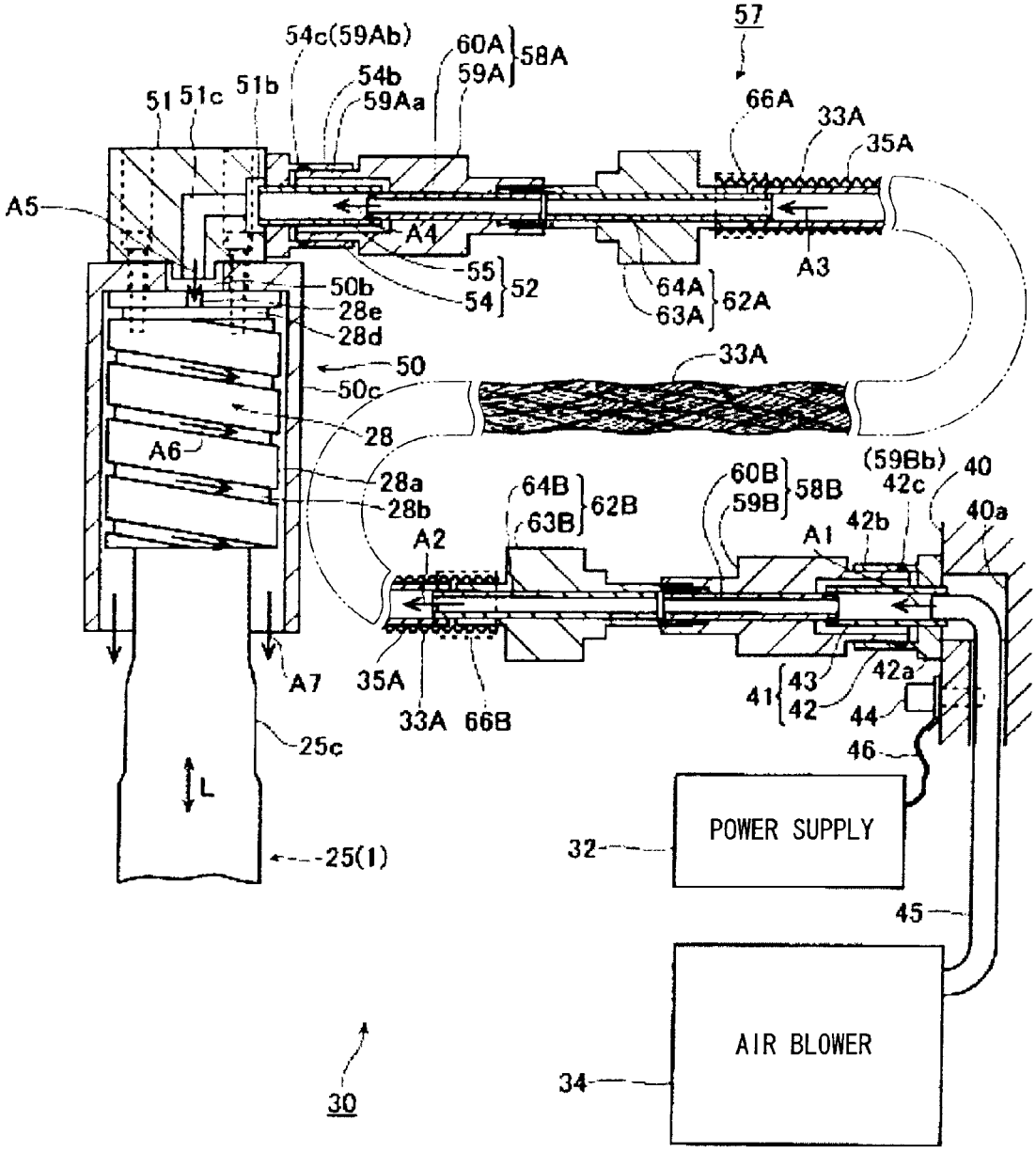

FIG. 5 is a partial cutaway view that shows the state of the power supply 32 and the air blower 34 coupled via the coupling cable 57 of FIG. 4 to the base-side connector 52 of the discharge lamp 1 of part (B) of FIG. 3.

Figure 6:
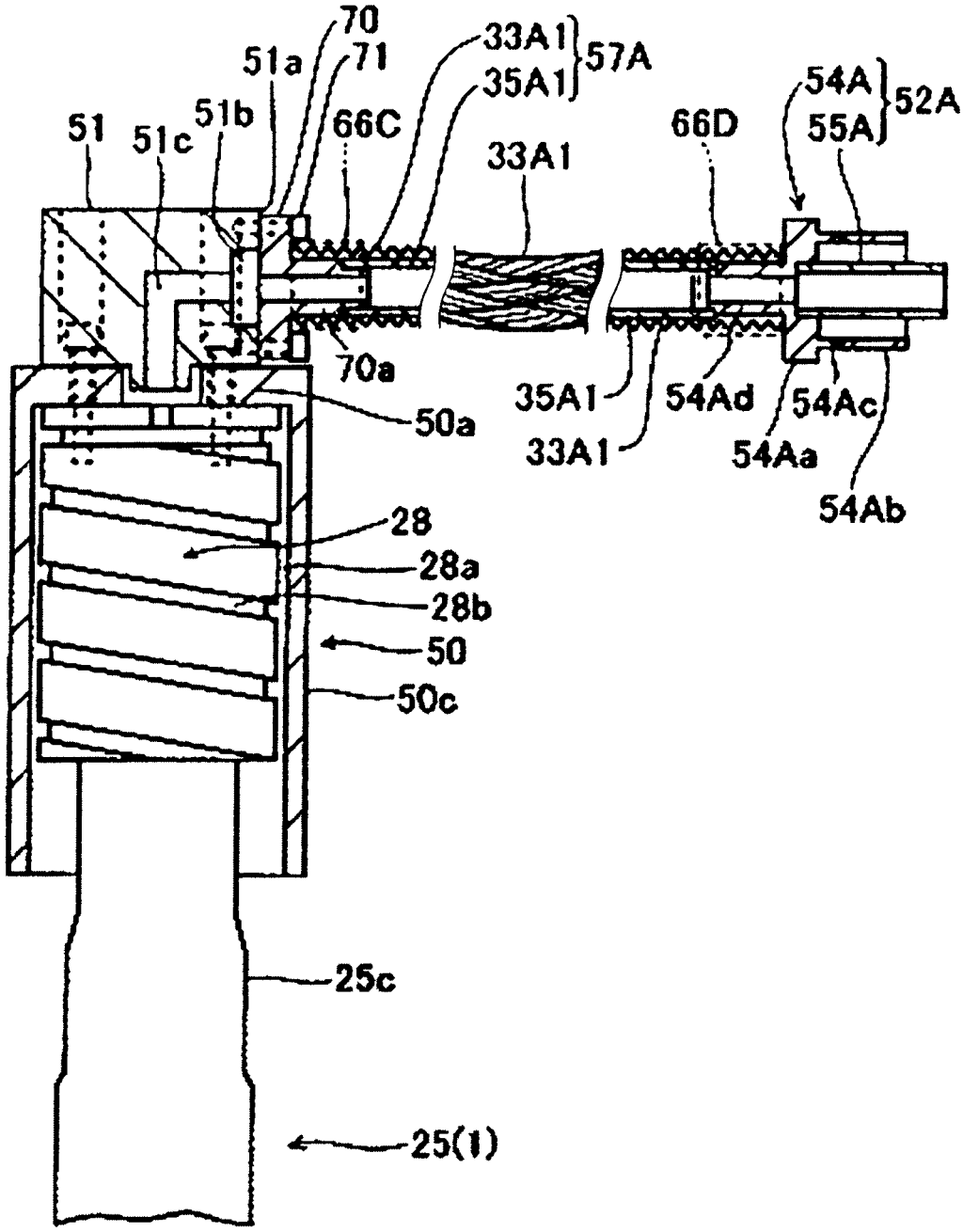

FIG. 6 is a partial cutaway view that shows the principal parts of an example that connects the extension cable 57A between the flow path bending member 51 of the discharge lamp 1 and the base side connector in a modification of the embodiment.

Figure 7:
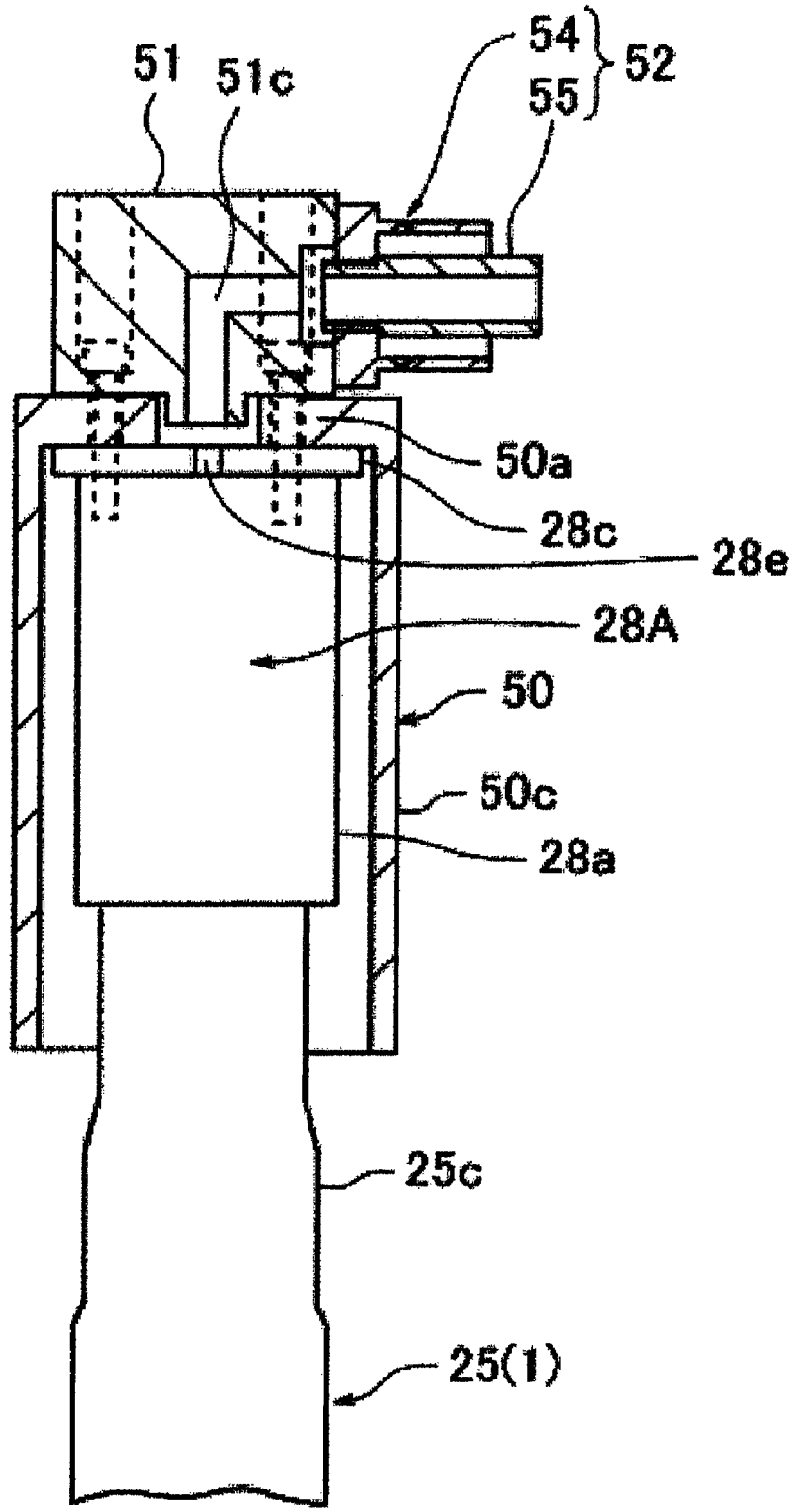

FIG. 7 is a partial cutaway view that shows the constitution in the vicinity of the base part of the modification of the embodiment.

DESCRIPTION OF EMBODIMENTS

One example of a preferred embodiment of the present invention is explained below, referencing FIG. 1 through FIG. 5.

FIG. 1 shows a projection exposure apparatus (exposure apparatus), which is provided with an exposure light source 30 of the present embodiment; in FIG. 1, a discharge lamp 1, which comprises an arc discharge type mercury lamp, is fixed to a fixed plate 29 that consists of an insulator via a mounting member 31. In addition, electric power is supplied from a power supply 32 to electrodes on a cathode side and an anode side in the discharge lamp 1 via flexible electric power cables 33A and 33B. Also, air that is passed through a dust control filter and cooled (hereinbelow referred to as cool air) is supplied from an air blower 34 via flexible air-blowing pipes 35A and 35B to the two bases of the discharge lamp 1. As the air blower 34, a mechanism can be used that supplies at a predetermined flow rate air (or nitrogen gas and the like that is draw in from a nitrogen cylinder) that is obtained by drawing in outside air and performing cleaning and cooling. As the air blower 34, otherwise it is possible to use a compressed air supply part that supplies compressed air for an air cylinder or the like in a factory. That cool air may be at room temperature, and does not necessarily need to be cooled below room temperature.

Also, an elliptical mirror 2 (condenser mirror) is fixed to a bracket (not shown) so that it surrounds a bulb part of the discharge lamp 1. A light emitting part inside the bulb part of the discharge lamp 1 is disposed in, for example, the vicinity of a first focal point P1 of the elliptical mirror 2. The exposure light source 30 comprises the discharge lamp 1, the elliptical mirror 2, the mounting member 31, the electric power cables 33A and 33B, the air-blowing pipes 35A and 35B, the power supply 32 and the air blower 34 (discussed later in detail).

A light beam emitted from the discharge lamp 1 is converged in the vicinity of a second focal point by an elliptical mirror 2, after which it passes through the vicinity of a shutter 3 in an open state, which changes the light beam to divergent light, and then impinges a mirror 4 that folds the optical path. The shutter 3 is opened and closed by a shutter drive apparatus 3*a*, and as one example, a stage control system 15 described below controls a shutter drive apparatus 3*a* based on an instruction from a main control system 14, which provides supervisory control of the operation of the entire apparatus.

The light beam reflected by the mirror 4 enters an interference filter 5, which selects just exposure light IL of a prescribed bright line (e.g., the i-line, which has a 365 nm wavelength). Furthermore, in addition to the i-line, it is possible to use the g-line, the h-line, light that combines such lines, or, for example, a bright line from a lamp other than a mercury lamp as the exposure light IL. The selected exposure light IL enters a fly-eye lens 6 (optical integrator), and numerous secondary light sources are formed on a variable aperture stop 7, which is disposed at the emergent surface of the fly-eye lens 6. The exposure light IL that passes through the variable aperture stop 7 then enters a reticle blind (variable field stop) 9 via a first relay lens 8. The plane in which the reticle blind 9 is disposed is substantially conjugate with a pattern surface of a reticle R, and an illumination area on the reticle R is defined by setting the shapes of the openings of the reticle blind 9 via a drive apparatus 9*a*. In addition, the configuration is such that the stage control system 15 can open and close the reticle blind 9 via the drive apparatus 9*a* so that a wafer W is not unnecessarily irradiated with exposure light when, for example, the wafer W is stepped.

The exposure light IL that passes through the reticle blind 9 downwardly illuminates a pattern area of the pattern surface of the reticle R via a second relay lens 10, a dichroic mirror 11 that reflects the exposure light IL, and a condenser lens 12. The illumination optical system 13 comprises the shutter 3, the mirror 4, the interference filter 5, the fly-eye lens 6, the variable aperture stop 7, the relay lenses 8 and 10, the reticle blind 9, the dichroic mirror 11, and the condenser lens 12. The light beam from the exposure light source 30, which serves as the exposure light IL, illuminates the reticle R (mask) via the illumination optical system 13, and one shot region of the wafer W (photosensitive substrate), which is coated with photoresist, is exposed at a projection magnification β (β is, for example, ¼ or ⅕) with the pattern inside the pattern area of the reticle R via a projection optical system PL. In the explanation below, the Z axis is parallel to an optical axis AX of the projection optical system PL, the X axis is parallel to the paper surface of FIG. 1 within a plane that is perpendicular to the Z axis, and the Y axis is perpendicular to the paper surface in FIG. 1.

At this time, the reticle R is held on a reticle stage RST, which is finely movable in the X and Y directions and in the rotational directions around the Z axis, on a reticle base (not shown). The position of the reticle stage RST is measured with high accuracy by a laser interferometer 18R that irradiates a movable mirror 17R, which is fixed to the reticle stage RST, with a measuring laser beam, and that measured value is supplied to the stage control system 15 and the main control system 14. Based on that measured value and control information from the main control system 14, the stage control system 15 controls the position of the reticle stage RST via a drive system 19R, which comprises a linear motor, etc.

Moreover, the wafer W is held on a wafer stage WST via a wafer holder (not shown), and the wafer stage WST is mounted on a wafer base (not shown) so that it is freely movable in the X and Y directions. The position of the wafer stage WST is measured with high accuracy by a laser interferometer 18W that irradiates a movable mirror 17W, which is fixed to the wafer stage WST, with a measuring laser beam, and that measured value is supplied to the stage control system 15 and the main control system 14. Based on that measured value and control information from the main control system 14, the stage control system 15 controls the position of the wafer stage WST (wafer W) via a drive system 19W, which comprises a linear motor, etc.

When exposing the wafer W, a step-and-repeat system repetitively performs: an operation wherein the wafer stage WST moves a shot region of the wafer W into the exposure field of the projection optical system PL; and an operation wherein the reticle R is irradiated with the light beam from the exposure light source 30 via an illumination optical system 13 and the relevant shot region on the wafer W is exposed with the pattern of the reticle R via the projection optical system PL. Thereby, the image of the pattern of the reticle R is transferred to each shot region on the wafer W.

Furthermore, in order to perform alignment beforehand when performing this exposure, a reticle alignment microscope 20 that detects the position of an alignment mark formed in the reticle R is installed above the reticle R, and an alignment sensor 21 that detects the position of an alignment mark, which is accessorily provided to each shot region on the wafer W, is installed on a side surface of the projection optical system PL. In addition, a reference mark member 22, wherein a plurality of reference marks is formed for the alignment sensor 21 and the like, is provided in the vicinity of the wafer W on the wafer stage WST. The detection signals of the reticle alignment microscope 20 and the alignment sensor 21 are supplied to an alignment signal processing system 16, which derives the array coordinates of the detected mark by, for example, performing image processing on the detection signals, and this array coordinate information is supplied to the main control system 14. The main control system 14 aligns the reticle R and the wafer W based on the array coordinate information.

The following explains the basic constitution of the exposure light source 30 that includes the discharge lamp 1 of the projection exposure apparatus of the present embodiment.

Part (A) of FIG. 2 is a partial cutaway view that shows the discharge lamp 1 in the exposure light source 30 of FIG. 1; in part (A) of FIG. 2, the discharge lamp 1 comprises: a glass tube 25, which comprises a bulb part 25*a* and two substantially symmetric cylindrical rod-shaped parts 25*b* and 25*c* that are fixed so that they sandwich the bulb part 25*a*; a cathode-side base part (ferrule member) 26, which is coupled to an end part of the rod-shaped part 25*b* on the fixed side; and an anode-side base part (ferrule member) 28 that is coupled to an end part of the rod-shaped part 25*c* on the free end side, the diameter of which decreases toward its outer side in steps. An anode EL1 and a cathode EL2, which form the light emitting part in the bulb part 25*a*, are opposingly fixed, and the cathode EL2 and the anode EL1 are connected to the base parts 26 and 28, respectively; in addition, the base parts 26 and 28 are made of a metal that has satisfactory electrical and thermal conductivity. The base part 26, the glass tube 25, and the base part 28 are disposed along a straight line that links the center axes of the rod-shaped parts 25*b* and 25*c* of the glass tube 25 and passes through the center of the light emitting part. The direction that is parallel to the straight line that links the center axes of the rod-shaped parts 25*b* and 25*c* is longitudinal direction L of the discharge lamp 1.

The base parts 26 and 28 basically are used as electric power receiving terminals for supplying electric power from the power supply 32 to the cathode EL2 and the anode EL1 via the electric power cables 33B and 33A (refer to FIG. 1), respectively. In addition, the base part 26 is also used as a held part for holding the glass tube 25 (discharge lamp 1), and a mechanism is provided in both base parts 26 and 28 wherethrough a gas flows in order to dissipate the heat that is conducted from the glass tube 25.

Namely, in sequence from the rod-shaped part 25*b* to the outer side, the following parts are formed in the base part 26, which is connected to the cathode EL2: a flange part 26*a*; a columnar shaft part 26*b*; a columnar recessed part 26*f*; and a columnar fixed part 26*h*, which has an outer diameter that is slightly smaller than that of the shaft part 26*b*; furthermore, a pressed surface 26*g* is formed at the border between the recessed part 26*f* and the fixed part 26*h*. The pressed surface 26*g* lies in a plane that is orthogonal to the longitudinal direction L.

When attaching the discharge lamp 1, the shaft part 26*b* of the discharge lamp 1 mates with an opening part 31*b* of the mounting member 31 shown by the double dashed line, and the flange part 26*a* is placed on an upper surface 31*a* of the mounting member 31. As shown in part (B) of FIG. 2, circular openings 27A and 27B are formed in the flange part 26*a*, and by inserting columnar projections (not shown) that are fixed to the upper surface 31*a* of part (A) of FIG. 2 through these openings 27A and 27B, positioning of the discharge lamp 1 in the rotational direction is performed.

Also, a groove part 26*d* is formed in a spiral shape on an outer surface of the shaft part 26*b* around an axis that is parallel to the longitudinal direction L. Cool air is supplied to the groove part 26*d* via a flexible air-blowing pipe 35B from the air blower 34 and an air-blowing path 31*c* that is formed in the mounting member 31. Also, a terminal 38 is fixed to the metal mounting member 31 having good conductivity by a bolt 39, and the terminal 38 is connected to the power supply 32 by the electric power cable 33B. With this constitution, electric power is supplied from the power supply 32 to the cathode EL2 of the discharge lamp 1 via the electric power cable 33B, the terminal 38, the mounting member 31, and the flange part 26*a* of the base part 26.

Also, urging members 36A, 36B, 36C are fixed at three locations below the mounting member 31 so as to be freely rotatable and urged downward by tension coil springs 37A, 37B, and 37C. By urging the pressed surface 26*g* of the base part 26 downward by the distal end parts of the urging members 36A to 36C, the base part 26 (and by extension the discharge lamp 1) is stably held by the mounting member 31. Moreover, by raising upward the urging members 36A to 36C by a lever mechanism not shown, it is possible to easily remove the discharge lamp 1 from the mounting member 31.

Next, in part (A) of FIG. 2, in the schematic configuration of the base part 28 of the anode side of the discharge lamp 1 (the free end side in the present embodiment), a groove part 28*b* is formed in a spiral shape on an outer surface of the nearly columnar shaft part 28*a* around an axis that is parallel to the longitudinal direction L. Moreover, a nearly cylindrical cover member 50 made of metal with good electrical conductivity (for example, copper, brass, aluminum, and the like, the same below) is fixed so as to cover the base part 28 from the outer side. A nearly circular flow path bending member 51 that is made of metal with good electrical conductivity is fixed on the cover member 50, and a base-side connector 52 is fixed on a side surface 51*a* that is machined flat facing a direction orthogonal to the longitudinal direction L of the flow path bending member 51 (refer to part (B) of FIG. 3). The electric power cable 33A and the air-blowing pipe 35A of FIG. 1 can be coupled to a coupling part that faces a direction orthogonal to the longitudinal direction L of the base-side connector 52 (described in detail below).

In the case of providing the base-side connector 52 in order to couple the electric power cable 33A and the air-blowing pipe 35A facing a direction orthogonal to the longitudinal direction L of the discharge lamp 1 in this manner, as shown in FIG. 1, it is possible to separate the electric power cable 33A and the air-blowing pipe 35A from a second focal point P2 at which a light beam emitted from the discharge lamp 1 is converged by an elliptical mirror 2. Accordingly, the amount of blocked light of the light beam from the discharge lamp 1 due to the electric power cable 33A and the air-blowing pipe 35A is less, and the members that are heated by that light beam are fewer, and so the temperature rise of the discharge lamp 1 is restricted.

Part (B) of FIG. 3) is an enlarged cross sectional view that shows the constitution in the vicinity of the base part 28 on the anode side of the discharge lamp 1 of part (A) of FIG. 2, part (A) of FIG. 3 is a plan view of part (B) of FIG. 3, and part (C) of FIG. 3 is a side view of the principal parts of part (B) of FIG. 3. In part (B) of FIG. 3, a circular mount part 28*c* is formed on the upper end of the shaft part 28*a* in which is formed the groove part 28*b* of the base part 28, spaced apart therefrom by a ring-shaped cutaway part 28*d*, and a groove part 28*e* for ventilation is formed from the center part of the mount part 28*c* to the outside.

Also, the cover member 50 has an annularly formed flat part 50*a* that is placed on the upper surface of the mount part 28*c* and a cylindrical part 50*c* that covers the side surface of the base part 28, and a distal end part 50*ca* of the cylindrical part 50*c* further extends from the base part 28 to the side of the rod-shaped part 25*c* of the glass tube 25. Note that in part (B) of FIG. 3 a gap is drawn between the shaft part 28*a* and the cylindrical part 50*c*, but this gap may in reality be made extremely small.

A cylindrical projecting part 51*d* is formed on the bottom surface of the flow path bending member 51 that is fixed on the cover member 50 so as to project out to an opening 50*b* in the center of the flat part 50*a* of the cover member 50, and an air-blowing path 51*c* for supplying cool air is formed so as to head from the center part of this projecting part 51*d* to the center part of the flow path bending member 51, and there bend toward the flat side surface 51*a*, and the distal end part of the air-blowing path 51*c* is in communication with a recessed part 51*b* that is provided in the side surface 51*a*. Also, as shown in part (A) of FIG. 3, a countersunk part 51*e* is formed at four locations on the upper surface of the flow path bending member 51, and as shown in part (B) of FIG. 3, the flow path bending member 51 and the cover member 50 (opening for a bolt 53 is provided) are integrally fixed to the base part 28 by the bolts 53 in the countersunk part 51*e*.

Also, a base-side connector 52 has a fixed part 54 that is fixed to the side surface 51*a* of the flow path bending member 51, and a cylinder part 55 that is fixed so as to threadably mount the center opening part of the fixed part 54 by a screw part 55*a*, with the fixed part 54 and the cylinder part 55 both being made of metal with good electrical conductivity. The fixed part 54 has a flat part 54*a* that is fixed to the side surface 51*a* and a cylinder part 54*b* that is projected to the outside, and recessed parts 54*c* are formed at three locations in the cylinder part 54*b*. Also, a countersunk part 54*d* is formed as shown in part (C) of FIG. 3 at four locations of the flat part 54*a*, and the fixed part 54 (and by extension the base-side connector 52) is fixed to the side surface 51*a* of the flow path bending member 51 by the bolts 56 in the countersunk part 54*d*.

In part (B) of FIG. 3, the electric power that is supplied to the fixed part 54 of the base-side connector 52 via the electric power cable 33A of FIG. 1 is supplied to the anode in the glass tube 25 via the flow path bending member 51, the cover member 50, and the base part 28. Also, the cool air that is supplied to the cylinder part 55 of the base-side connector 52 via the air-blowing pipe 35A of FIG. 1 passes through the recessed part 51*b* of the flow path bending member 51, the air-blowing path 51*c*, the opening 50*b* of the cover member 50, the groove part 28*e*, and a cutaway part 28*d* to be supplied to the groove part 28*b* of the base part 28, and the air that has flowed through the groove part 28*b* is blown from the space between the rod-shaped part 25*c* and the distal end part 50*ca* of the cover member 50 to the side of the bulb part 25*a* of the glass tube 25 of part (A) of FIG. 2. Thereby, the base part 28 and the glass tube 25 are efficiently cooled.

Next, FIG. 4 shows a coupling cable 57 of the present embodiment that includes the electric power cable 33A and the air-blowing pipe 35A of FIG. 1, and in FIG. 4, the coupling cable 57 is constituted by coupling the coupling cable 57, a cable-side first connector 58A, a cable side first coupling member 62A, the electric power cable 33A and the air-blowing pipe 35A, a cable side second coupling member 62B, and a cable-side second connector 58B. The cable-side first connector 58A has a main body member 59A that has a cylindrical distal end part 59Aa and a long, thin cylindrical member 60A that is fixed in the main body member 59A by a setscrew 61A. Projecting parts 59Ab are provided at three locations on the outer surface of the distal end part 59Aa, and a slotted part for imparting flexibility to the position that sandwiches the projecting part 59Ab of the distal end part 59Aa in the circumferential direction (not shown) is formed. The cylindrical member 60A is a size which can be inserted in the cylinder part 55 of the base-side connector 52 of part (A) of FIG. 3, and the distal end part 59Aa of the main body member 59A is a size that fits the inner surface of the cylinder part 54*b* of the fixed part 54 of the base-side connector 52 of part (A) of FIG. 3. In the state of the distal end part 59Aa being inserted in the cylinder part 54*b*, the projecting part 59Ab of the distal end part 59A is housed in the recessed part 54*c* in the cylinder part 54*b* of part (B) of FIG. 3, and the distal end part 59Aa is stably held in the cylinder part 54*b*. Note that a tapered part is formed at the distal end part of the cylindrical member 60A so that it can be easily coupled with the cylinder part 55, but for example this tapered part may be omitted if the machining accuracy is high.

In FIG. 4, the cable side first coupling member 62A has a main body member 63A that has a distal end part 63Aa that is fixed by being threadably mounted on a screw part 59Ac of the main body member 59A of the cable-side first connector 58A, and a long, thin cylindrical member 64A that is fixed in the main body member 63A by a setscrew 65A, a cylinder part 63Ab is formed at the other end side of the main body member 63A, and the cylindrical member 64A projects further out to the outer side from the cylinder part 63Ab. The main body member 59A and the cylindrical member 60A of the cable-side first connector 58A, and the main body member 63A and the cylindrical member 64A of the cable side first coupling member 62A all are made of metal with good electrical conductivity.

Also, in the present embodiment, as shown by the appearance of the arrow B, the electrical cable 33A is a member in which a plurality of long, thin lead wires can be woven in a cylindrical mesh shape, and the air-blowing pipe 35A that is long and thin, cylindrical, and flexible by being made of a soft synthetic resin (such as plasticized polyvinyl chloride, low-density polyethylene, and the like, the same below) or synthetic rubber and the like is housed in this electric power cable 33A. Both end parts of this electric power cable 33A are extended longer than the air-blowing pipe 35A, and the air-blowing pipe 35A is a size that is capable of housing the cylindrical member 64A of the cable side first coupling member 62A. And, a metal belt part 66A is fixed so as to fasten the distal end part of the air-blowing pipe 35A and the cylinder part 63Ab with the electric power cable 33A, in the state of the distal end part of the cylindrical member 64A being inserted in the air-blowing pipe 35A, and the distal end part of the electric power cable 33A covering the cylinder part 63Ab of the cable side first coupling member 62A.

The cable side second coupling member 62B is constituted by fixing a cylindrical member 64B on a main body member 63B with a setscrew 65B symmetrically with the cable side first coupling member 62A, and the cable-side second connector 58B is constituted by fixing a cylindrical member 60B on a main body member 59B with a setscrew 61B symmetrically with the cable-side first connector 58A. The main body members 59B and 63B and the cylindrical members 60B and 64B are all made of metal having good electrical conductivity, and a metal belt part 66B is fixed so as to tighten the distal end part of the air-blowing pipe 35A in which the distal end part of the cylindrical member 64 is inserted and the cylinder part 63Bb of the main body member 63B with the electric power cable 33A. Thereby, the coupling members 62A and 62B on the cable side and the electric power cable 33A and air-blowing pipe 35A are coupled so that the air-blowing pipe 35A and the cylindrical members 64A and 64B are in communication and the electric power cable 33A and the main body members 63A and 63B are electrically connected.

Also, a distal end part 63Ba of the main body member 63B of the cable side second coupling member 62B is fixed by being threadably mounted in a screw part 59Bc of the main body member 59B of the cable-side second connector 58B. Projecting parts 59Bb are formed at three locations on the outer surface of a cylindrical distal end part 59Bc of the main body member 59B of the cable-side second connector 58B.

In the coupling cable 57 of FIG. 4, electric power that is supplied from the power supply 32 of FIG. 1 to the main body member 59B of the cable-side second connector 58B is supplied to the base-side connector 52 of part (B) of FIG. 3 via the main body member 63B of the cable side second coupling member 62B, the electric power cable 33A, the main body member 63A of the cable side first coupling member 62A, and the main body member 59A of the cable-side first connector 58A. Also, the cool air that is supplied from the air blower 34 of FIG. 1 to the inside of the cylindrical member 60B of the cable-side second connector 58B of FIG. 4 is sent to the cylinder part 55 of the base-side connector 52 of part (B) of FIG. 3 via the cylindrical member 64B of the cable side second coupling member 62B, the air-blowing pipe 35A, the cylindrical member 64A of the cable side first coupling member 62A and the cylindrical member 60A of the cable-side first connector 58A.

Note that it is possible to omit the cylindrical members 60A, 64A, 64B, and 60B in the coupling cable 57. Moreover, by omitting the cable side coupling members 62A and 62B, it is possible to adopt a constitution that couples the electric power cable 33A and the air-blowing pipe 35A to the cable-side connectors 58A and 58B.

Next, FIG. 5 shows the state of the base-side connector 52 of part (B) of FIG. 3 and the power supply 32 and the air blower 34 of FIG. 1 being coupled (connected) with the coupling cable 57 of FIG. 4, and in this FIG. 5, a flat part 42*a* of a power supply-side connector 41 that consists of a fixed part 42 made of a metal with good conductivity and a cylinder part 43 having the same structure as the base-side connector 52 of part (B) of FIG. 3 is fixed by a bolt (not shown) to a mounting member 40 made of a metal with good electrical conductivity. A cylinder part 42*b* of the fixed part 42 is a size in which the distal end part 59Ba of the cable-side second connector 58B of the coupling cable 57 of FIG. 4 can fit the inner surface thereof, and the cylinder part 43 is a size in which the cylindrical member 60B of the cable-side second connector 58B can be inserted along the inner side thereof. Also, a recessed part 42*c* is formed in the inner surface of the cylinder part 42*c* of FIG. 5 so as to correspond to the projecting part 59Bb of the distal end part 58Ba of the cable-side second connector 58B. Note that a tapered part is formed at the distal end part of the cylindrical member 60B so to readily be able to connect with the cylinder part 43, but for example this tapered part may be omitted if the machining accuracy is high.

Also, the terminal that is fixed by the bolt 44 to the mounting member 40 is coupled to the power supply 32 by the electric power cable 46, and the electric power cable 46 and the fixed part 42 of the power supply-side connector 41 are electrically connected. Moreover, the cylinder part 43 of the power supply-side connector 41 is coupled to the air blower 34 via a recessed part 40*a* that is provided in the mounting member 40 and a pipe 45 that is routed along the pipe path, and thus constituted so that it is possible to supply cool air from the air blower 34 to the cylinder part 43 of the power supply-side connector 41.

In FIG. 5, in order to connect the coupling cable 57 to the base-side connector 52 of the discharge lamp 1, the distal end part 59Aa of the cable-side first connector 58A of the coupling cable 57 may be inserted in the cylinder part 54*b* of the base-side connector 52, and the projecting part 59Ab of the distal end part 59Aa may be fitted in the recessed part 54*c* in the cylinder part 54*b*. Note that as the coupling method of the distal end part 59Aa and the cylinder part 54*b*, besides the method of mating the projecting part 59Ab and the recessed part 54*c*, it is possible to use any method that is used in coupling of ordinary connectors. The same is true for the coupling of the coupling cable 57 and the power supply-side connector 41. That is, in order to connect the coupling cable 57 with the power supply-side connector 41, the distal end part of the cable-side second connector 58B of the coupling cable 57 is inserted in the cylinder part 42*b* of the power supply-side connector 41, and the projecting part 59Bb of the distal end part thereof is fitted in the recessed part 42*c* in the cylinder part 42*b*. In this way, by using the coupling cable 57, it is possible to connect the power supply 32 and the air blower 34 with the discharge lamp 1 in an extremely easy and fast manner.

In this case, the cylinder part 54*b* of the base-side connector 52 of the discharge lamp 1 and the distal end part 59Aa of the cable-side first connector 58A of the coupling cable 57 are coupled. For this reason, the cylindrical member 60A of the cable-side first connector 58A is inserted in the cylinder part 55 of the base-side connector 52 so that both are in communication. Moreover, the cylinder part 42*b* of the power supply-side connector 41 and the distal end part of the cable-side second connector 58B of the coupling cable 57 are coupled. For this reason, the cylindrical member 60B of the cable-side second connector 58B is inserted in the cylinder part 43 of the power supply-side connector 41, so that both are in communication.

In FIG. 5, the electric power supplied from the power supply 32 to the fixed part 42 of the power supply-side connector 41 via the electric power cable 46 is supplied to the fixed part 54 and the cylinder part 55 of the base-side connector 52 via the cable-side second connector 58B (the main body member 59B) of the coupling cable 57, the cable side second coupling member 62B (main body member 63B), the electric power cable 33A, the cable side first coupling member 62A (main body member 63A), and the cable-side first connector 58A (main body member 59A). The electric power that is supplied to the fixed part 54 of the base-side connector 52 is supplied to the anode in the glass tube 25 via the flow path bending member 51, the cover member 50, and the base part 28.

Moreover, the cool air that is supplied from the air blower 34 to the cylinder part 43 of the power supply-side connector 41 via the pipe 45 is sent into the cylinder part 55 of the base-side connector 52 via the cylindrical member 60B of the cable-side second connector 58B of the coupling cable 57, the cylindrical member 64B of the cable side second coupling member 62B, the air-blowing pipe 35A, the cylindrical member 64A of the cable side first coupling member 62A, and the cylindrical member 60A of the cable-side first connector 58A as shown by the arrows A1, A2, A3, and A4. The cool air that is supplied to the cylinder part 55 is as shown by the arrows A5, A6, and A7 sent to the bulb part 25*a* (refer to part (A) of FIG. 2) side of the glass tube 25 through the air-blowing path 51*c* of the flow path bending member 51, the opening 50*b* of the cover member 50, the groove part 28*e*, the cutaway part 28*d*, the groove part 28*b* of the base part 28, and the space between the rod-shaped part 25*c* and the distal end part 50*ca* of the cover member 50. Thereby, the base part 28 and the glass tube 25 are efficiently cooled.

Also, in FIG. 5, when the coupling cable 57 is separated from the discharge lamp 1 in order to, for example, perform maintenance of the discharge lamp 1, the distal end part 59Aa of the cable-side first connector 58A of the coupling cable 57 may be pulled out from the cylinder part 54*b* of the base-side connector 52. Also, in order to remove the coupling cable 57 from the power supply 32 and the air blower 34, the distal end part of the cable-side second connector 58B of the coupling cable 57 may be pulled out from the cylinder part 42*b* of the power supply-side connector 41. By using the coupling cable 57 in this way, it is possible to separate the power supply 32 and the air blower 34 from the discharge lamp 1 in an extremely easy and fast manner.

The operational advantages of the exposure light source 30 and the exposure apparatus of the present embodiment are as follows.

(1) The discharge lamp 1 of part (B) of FIG. 3 is provided with the base part 28 that is coupled to the glass tube 25, the flow path bending member 51 that is provided on this base part 28 and that formed with an electrically conductive material, the base-side connector 52 that has the fixed part 54 that is continuous with this flow path bending member 51, and the air-blowing path for flowing cool air to the base part 28, including the air-blowing path 51*c* in the flow path bending member 51 and the air-blowing path in the cylinder part 55 of the base-side connector 52.

Accordingly, electric power for electric discharge is supplied to the electrodes for electric discharge via the fixed part 54 of the base-side connector 52, the flow path bending member 51, and the base part 28, and cold air is supplied to the base part 28 via the air-blowing paths in the flow path bending member 51 and the base-side connector 52. Thereby, the base part 28 is efficiently cooled.

(2) Also, the distal end part of the fixed part 54 of the base-side connector 52 is cylindrical, and the cylinder part 55 that forms the flow path is installed inside of it. Accordingly, in addition to being able to easily couple the cable-side first connector 58A of the coupling cable 57 of FIG. 4 to the distal end part of the fixed part 54, it is possible to have the air-blowing path in the cylindrical member 60A in the cable-side first connector 58A communicate with the air-blowing path in the cylinder part 55 along with this coupling.

(3) Also, the base part 28 is coupled in the longitudinal direction L to the glass tube 25 (refer to part (A) of FIG. 2), and the base-side connector 52 is mounted on the flow path bending member 51 so that the distal end part of the fixed part 54 faces a direction that is orthogonal to (or a direction that intersects) the longitudinal direction L. Accordingly, since it is possible to couple the coupling cable 57 of FIG. 4 to the base-side connector 52 in a direction that is orthogonal to the longitudinal direction L, it is possible to arrange the coupling cable 57 away from the second focal point P2 of the elliptical mirror 2 of FIG. 1. Accordingly, it is possible to minimize the amount of blocked light of the light from the discharge lamp 1 by the coupling cable 57.

(4) Also, the flow path bending member 51 of part (B) of FIG. 3 has the air-blowing path 51*c* that heads from a direction that is orthogonal to (or a direction that intersects) the longitudinal direction L to the longitudinal direction L. Accordingly, by bending the cool air that is supplied from the direction that is orthogonal to the longitudinal direction L, it can be supplied in the direction of the base part 28.

(5) Also, the cover member 50 that has the cylindrical part 50*c* that covers the side surface of the base part 28 is fixed to the bottom surface of the flow path bending member 51 of part (B) of FIG. 3, and the air-blowing path 51*c* in the flow path bending member 51 is in communication with the air-blowing path between the cover member 50 and the base part 28. Accordingly, it is possible to efficiently cool the base part 28.

(6) Also, in the present embodiment, cool air is supplied to the glass tube 25 side via the space between the cover member 50 and the base part 28. By supplying air that has cooled the base part 28 in this way to the glass tube 25 side, the glass tube 25 is also cooled. In relation to this, by extending the distal end part 50*ca* of the cylinder part 50*c* of the cover member 50 further than the base part 28, it is possible to raise the cooling effect with respect to the glass tube 25 side. However, for example, in the case of the amount of blown air being large, it is not always necessary to extend the distal end part 50*ca* further than the base part 28.

Instead of cool air (or another gas), it is acceptable to use a cooled fluid (pure water, fluorine-based inert liquid, and the like). In this case, it is possible to provide a recovery path in order to recover the fluid that is flowed to the surface of the base part 28, to be re-cooled and supplied to the base-side connector 52 side.

(7) Also, the groove part 28*b* as an air-blowing path is formed in a spiral shape on the surface of the shaft part 28*a* of the base part 28 between the cover member 50 and the base part 28. In this way, by flowing air in a spiral shape on the surface of the base part 28, it is possible to improve the cooling efficiency of the base part 28.

Note that instead of providing the groove part 28*b* on the side of the shaft part 28*a* of the base part 28 in this way, it is possible to form a spiral-shaped groove part in a region of the cylinder part 50*c* of the cover part 50 that faces the shaft part 28*a*. By adopting such a constitution, it is possible to raise the cooling efficiency of the base part 28.

(8) Also, the mount part 28*c* is provided at the upper end of the base part 28 of part (B) of FIG. 3, and the spiral-shaped groove part 28*b* is in communication with the groove part 28*e* that is provided on the side surface of the mount part 28*c*. Accordingly, it is possible to install the cover member 50 and the flow path bending member 51 and the like on the mount part 28*c*, and it is possible to lead the cool air from the air-blowing path 51*c* of the flow path bending member 51 to the groove part 28*b* on the side surface of the base part 28 via the opening 50*b* of the cover member 50 and the groove part 28*e*.

(9) Also, the coupling cable 57 of FIG. 4 is a cable for coupling the discharge lamp 1 that uses cool air and electric power and the power supply 32 and the air blower 34 of FIG. 5, and is provided with the air-blowing pipe 35A that is formed with a flexible material and has the air-blowing path for cool air, and the electric power cable 33A that is formed with a flexible material having electrical conductivity and is provided so as to cover the air-blowing pipe 35A. In this case, the electric power from the power supply 32 is supplied to the discharge lamp 1 side via the electric power cable 33A, and the cool air from the air blower 34 is supplied to the discharge lamp 1 side via the air-blowing pipe 35A. Accordingly, it is possible to easily supply electric power and cool air to the discharge lamp 1 essentially using one cable.

(10) Also, since the electric power cable 33A is a member that consists of a plurality of lead wires woven in a mesh shape, it is possible to easily achieve both flexibility and conductivity.

(11) Also, the coupling cable 57 is provided with the cable-side first connector 58A that is coupled to one end of the electric power cable 33A and the air-blowing pipe 35A, and since it is connected with the base-side connector 52 of the discharge lamp 1 via the cable-side first connector 58A, it is possible to easily and quickly perform coupling to and separation from the discharge lamp 1.

(12) Also, the coupling cable 57 is provided with the cable-side second connector 58B that is coupled to the other end of the electric power cable 33A and the air-blowing pipe 35A, and connected with the power supply-side connector 41 on the side of the power supply 32 and the air blower 34 via this cable-side second connector 58B. Accordingly, it is possible to easily and quickly perform coupling to and separation from the power supply 32 and the air blower 34.

(13) Also, the exposure light source 30 of the present embodiment is an apparatus that is connected to the power supply 32 and the air blower 34 of FIG. 5, and is provided with the discharge lamp 1 and the coupling cable 57 of FIG. 5, and connects the power supply 32 and the air blower 34 with the discharge lamp 1 via the coupling cable 57. Accordingly, the electric power from the power supply 32 is supplied to the discharge electrodes via the electric power cable 33A of the coupling cable 57, the fixed part 54 of the base-side connector 52 of the discharge lamp 1, the flow path bending member 51, and the base part 28. Moreover, the cool air from the air blower 34, after passing through the air-blowing pipe 35A in the electric power cable 33A of the coupling cable 57, is supplied to the base part 28 through the air-blowing path in the base-side connector 52 and the flow path bending member 51 of the discharge lamp 1. Accordingly, the cooling action on the base part 28 is large. Also, the base part 28 of the present example is the free end side of the discharge lamp 1, but since the amount of blocked light of the light that is generated from the discharge lamp 1 by the coupling cable 57 is small, the utilization efficiency of the light is high, and the temperature rise of the discharge lamp 1 is small.

(14) Also, the exposure apparatus of the present embodiment is an exposure apparatus that exposes the pattern of the reticle R onto a wafer W (photosensitive substrate) using exposure light that is generated from the discharge lamp 1, and uses the exposure light source 30 of the present embodiment as the exposure light source. Accordingly, the amount of blocked light of the light from the discharge lamp 1 is reduced, and it is possible to increase the throughput of the exposure step by increasing the illumination of the exposure light. Furthermore, it is possible to efficiently cool the discharge lamp 1, and so since heat deformation is reduced, it is possible to improve the image formation characteristics.

In the above embodiment, the base-side connector 52 is directly fixed to the side surface 51*a* of the flow path bending member 51 of the discharge lamp 1 as shown in part (B) of FIG. 3. However, instead of this, a base-side connector 52A may be coupled to the side surface 51*a* of the flow path bending member 51 via an extension cable 57A as shown in FIG. 6.

FIG. 6 shows the constitution of a portion that includes the anode-side base part 28 of the discharge lamp 1 of this modification. In FIG. 6, the coupling member 70 in which an opening for air blowing is formed in the center is formed is fixed by a bolt 71 on the side surface 51*a* of the flow path bending member 51. Also, the extension cable 57A is constituted from an electric power cable 33A1 and an air-blowing pipe 35A1 of the same constitution as the electric power cable 33A and the air-blowing pipe 35A in the coupling cable 57 of FIG. 4 (however, differing on the point of the length in this modification being shorter), and the air-blowing pipe 35A1 is housed in the electric power cable 33A1 that is woven into a mesh shape.

Also, the base-side connector 52A that is provided with a fixed part 54A and a cylinder part 55A differs from the base-side connector 52 of part (B) of FIG. 3 on the point of a cylindrical coupling part 54Ad in the base-side connector 52A being formed on the bottom surface of the fixed part 54A, and the cylinder part 55A being fixed by threadably mounting to the flat part of the fixed part 54A and not projecting out. Otherwise the constitution is the same as the base-side connector 52, and a recessed part 54Ac that corresponds to the projecting part 59Ab of the coupling cable 57 of FIG. 4 is formed in the cylinder part 54Ab of the fixed part 54A.

Also, one end of the air-blowing pipe 35A is arranged so as to cover the distal end part of the cylinder part 70*a* in the state of the electric power cable 33A1 covering the cylinder part 70*a* of the coupling member 70, and a metal belt part 66C is fixed so as to fasten the distal end part 70*a* with the electric power cable 33A1. Similarly, the other end of the air-blowing pipe 35A1 is arranged so as to cover the distal end part of the coupling part 54Ad in the state of the cable 33A1 covering the coupling part 54Ad of the fixed part 54A of the base-side connector 52A, and a metal belt part 66D is fixed so as to fasten the coupling part 54Aa with the electric power cable 33A1.

As a result, the fixed part 54A of the base-side connector 52A is electrically connected to the flow path bending member 51 via the electric power cable 33A1 of the extension cable 57A and the coupling member 70, and the cylinder part 55A of the base-side connector 52A is in communication with the air-blowing path 51*c* of the flow path bending member 51 via the air-blowing pipe 35A1 of the extension cable 57A and the coupling member 70. Accordingly, by coupling the cable-side first connector 58A of the coupling cable 57 of FIG. 4 to the base-side connector 52A of FIG. 6 and coupling the cable-side second connector 58B to the power supply-side connector 41 of FIG. 5, it is possible to supply electric power and cool air to the discharge lamp 1 of FIG. 6.

The operational effects of this modification are as follows.

(1) By providing the extension cable 57A that is arranged between the base-side connector 52A and the flow path bending member 51 and is capable of supplying electric power and cool air to the electrodes of the discharge lamp 1, when mounting and removing the extension cable 57 of FIG. 5 to and from the base-side connector 52A, no stress acts on the discharge lamp 1. Accordingly, there is the advantage of no risk of causing damage to the discharge lamp 1 during mounting and removing of the extension cable 57.

(2) Also, the extension cable 57A has the air-blowing pipe 35A1 that is formed with a flexible material with the inner part thereof serving as an air-blowing path, and the electric power cable 33A1 that is formed with a flexible material having electrical conductivity and covering the air-blowing pipe 35A1. Accordingly, since it is possible to supply electric power and cool air with essentially one cable, the piping does not become complicated.

(3) Also, since the electric power cable 33A1 is a member that consists of a plurality of lead wires woven in a mesh shape, it is possible to easily achieve both flexibility and conductivity.

(4) Also, since one end of the electric power cable 33A1 is fixed to the flow path bending member 51 via the coupling member 70, and the other end is fixed to the fixed part 54A of the base-side connector 52A, it is possible to electrically connect the base-side connector 52A and the flow path bending member 51 with a simple constitution.

Also in the above embodiment, the spiral-shaped groove part 28*b* is formed between the base part 28 and the cover member 50 as shown in part (B) of FIG. 3. However, as shown in FIG. 7, it is also possible to use a base part 28A in which a groove part and the like is not formed in the cylindrical shaft part 28*a*. In the constitution shown in FIG. 7, the air in the air-blowing path 51*c* of the flow path bending member 51 is supplied to the space between the shaft part 28*a* and the cylinder part 50*c* of the cover member 50 via the groove part 28*e* that is provided in a part of the mount part 28*c* of the base part 28A, and flows as is to the rod-shaped part 25*c* side along the surface of the shaft part 28*a*.

In addition, the projection exposure apparatus (exposure apparatus) of the abovementioned embodiment can be manufactured by: incorporating the exposure light source, the illumination optical system, which comprises a plurality of lenses and the like, and a projection optical system in an exposure apparatus main body, and then optically adjusting such; attaching the reticle stage, the wafer stage, and the like, each of which comprise numerous machine parts, to the exposure apparatus main body and then wiring and piping them; and performing an overall adjustment (electrical adjustment, operation verification, and the like). Furthermore, it is preferable to manufacture the projection exposure apparatus in a clean room in which the temperature, the cleanliness level, and the like are controlled.

In addition, a microdevice, such as a semiconductor device, is manufactured by, for example: a step that designs the functions and performance of the microdevice; a step that fabricates a mask (reticle) based on the designing step; a step that fabricates a substrate, which is the base material of the device; a substrate processing step that includes, for example, a process that exposes the pattern of the reticle onto the substrate (wafer and the like) by using the projection exposure apparatus of the embodiments discussed above, a process that develops the exposed substrate, and a process that heats (cures) and etches the developed substrate; a device assembling step (including dicing, bonding, and packaging processes); and an inspecting step.

Furthermore, the light source apparatus of the present invention can also be adapted to the exposure light source of the abovementioned step-and-repeat projection exposure apparatus (such as a stepper) as well as a step-and-scan scanning exposure type projection exposure apparatus (such as a scanning stepper). In addition, the light source apparatus of the present invention can also be adapted to the exposure light source of a liquid immersion type exposure apparatus as disclosed in, for example, PCT International Publication WO99/49504 and PCT International Publication WO2004/019128. In addition, the light source apparatus of the present invention can also be adapted to a light source apparatus of a proximity type or a contact type exposure apparatus, which do not use a projection optical system, or to the light source of equipment other than exposure apparatuses.

Furthermore, the embodiments discussed above use a reticle (mask) wherein a transfer pattern is formed, but an electronic mask may be used instead wherein a transmittance pattern or a reflected pattern is formed based on electronic data of the pattern to be exposed, as disclosed in, for example, U.S. Pat. No. 6,778,257.

In addition, the type of exposure apparatus is not limited to a semiconductor device fabrication exposure apparatus, but can also be adapted widely to an exposure apparatus that is used for fabricating displays, such as liquid crystal devices and plasma displays, and that transfers a device pattern onto a glass plate, an exposure apparatus that is used in the fabrication of thin film magnetic heads and that transfers a device pattern onto a ceramic wafer, and an exposure apparatus that is used for fabricating, for example, imaging devices (CCDs), OLEDs, micromachines, MEMS (microelectromechanical systems), and DNA chips. In addition to microdevices, such as semiconductor devices, the present invention can also be adapted to an exposure apparatus that transfers a circuit pattern to, for example, a glass substrate or a silicon wafer in order to fabricate a mask that is used by a light exposure apparatus, an EUV exposure apparatus, or the like.

Also, the coupling cable 57 of FIG. 4 of the abovementioned embodiment can be used in the case of coupling equipment other than an exposure apparatus that uses electric power and cool air, and the power supply 32 and the air blower 34 of FIG. 5.

The present invention is not limited to the embodiments discussed above, and it is understood that variations and modifications may be effected without departing from the spirit and scope of the invention.

According to a discharge lamp in an embodiment of the present invention, electric power for discharge is supplied to electrodes for discharge via the electrically conductive member of the coupling member, the relay member, and the base member. Moreover, the cooling medium is supplied to the base member via the flow path that is provided in the coupling member and the relay member.

According to a connecting cable in an embodiment of the present invention, electric power from the power supply is supplied to the apparatus side via the covering member that has flexibility, and the cooling medium from the supply source is supplied to the apparatus side through the inside of the flexible tubular member that is provided in the covering member.

Accordingly, according to the light source apparatus and the exposure apparatus in an embodiment, electric power from the power supply is supplied to the electrodes for discharge via the covering member of the connecting cable, the electrically conductive member of the coupling member of the discharge lamp, the relay member, and the base member. Moreover, the cooling medium from the supply source, after passing through the tubular member of the connecting cable, is supplied to the base member through the flow path of the coupling member and the relay member of the discharge lamp. Accordingly, the cooling action on the base member is large. Also, the cooling medium is supplied to the discharge lamp side through the flexible tubular member in the flexible covering member for electric power supply of the connecting cable. Accordingly, in the case of the base member thereof being at the free end side, the amount of blocked light of the light that is generated from the discharge lamp by the connecting cable is small, the utilization efficiency of the light is high, and the temperature rise of the light source apparatus is small.

What is claimed is:

1. A discharge lamp that houses electrodes for electric discharge in a glass member, comprising:

a base member that is coupled to the glass member;

a relay member that includes a cover member, which is attached to the base member and covers at least part of the base member and is formed with an electrically conductive material;

a coupling member that has an electrically conductive member that is electrically connected with the relay member; and a flow path that is provided in the relay member and the coupling member for supplying a cooling medium to a space which is formed between the base member and the cover member.

2. The discharge lamp according to claim 1, wherein the electrically conductive member is cylindrical, and a portion of the flow path is formed in the electrically conductive member.

3. The discharge lamp according to claim 2, wherein the base member is coupled to a first direction side of the glass member; and the coupling member is mounted on the relay member so that the cylindrical electrically conductive member is disposed in a direction that intersect with the first direction.

4. The discharge lamp according to claim 3, wherein:

the relay member has a flow path of the cooling medium that heads from a direction that intersects with the first direction to the first direction.

5. The discharge lamp according to claim 1, wherein a cable is provided that is arranged between the coupling member and the relay member and is capable of supplying electric power and the cool air to the electrode.

6. The discharge lamp according to claim 5, wherein the cable has a tubular member that is formed with a flexible material and that has a portion of the flow path, and a covering member that is formed with a flexible material that has electrical conductivity and that covers the tubular member.

7. The discharge lamp according to claim 6, wherein the covering member is a member that has a plurality of lead wires woven in a mesh shape.

8. The discharge lamp according to claim 6, wherein one end of the covering member is fixed to the relay member, and the other end is fixed to the electrically conductive member.

9. The discharge lamp according to claim 1, wherein the cover member has a cylinder part that covers at least a part of the base member, and the flow path is continuous between the cylinder part and the base member.

10. The discharge lamp according to claim 9, wherein the cooling medium is a cooled gas, and the cooled gas is supplied to the glass member side via a space between the cylinder part and the base member.

11. The discharge lamp according to claim 1, wherein at least a part of the flow path between the cylinder part of the relay member and the base member are formed in a spiral.

12. The discharge lamp according to claim 11, wherein a spiral groove part is formed on the surface of the base member.

13. The discharge lamp according to claim 12, wherein a projecting part is provided at the distal end part of the base member, and the spiral groove part is in communication with a cutout part that is provided in the side surface of the projecting part.

14. A connecting cable for coupling a discharge lamp that houses electrodes for electric discharge in a glass member and a supply source of a cooling medium and a power supply, comprising:

a tubular member that is formed with a flexible material and that has a flow path for the cooling medium;

a covering member that is formed with a flexible material having electrical conductivity is provided so as to cover the tubular member and supplies electric power from the power supply to the discharge lamp; and a first terminal member that is coupled to one end of the tubular member and coupled to one end of the covering member and can be connected to a connector, the connector being provided at a cover member which covers at least a part of a base member of the discharge lamp.

15. The connecting cable according to claim 14, wherein the covering member is a member that has a plurality of lead wires woven in a mesh shape.

16. The connecting cable according to claim 14, further comprising a second terminal member that is coupled to the other end of the tubular member and coupled to the other end of the covering member, wherein the connecting cable is connected to the supply source of the cooling medium and the power supply via the second terminal member.

17. A light source apparatus that is connected to a power supply and a supply source of a cooling medium, comprising:

the discharge lamp according to claim 1; and the connecting cable according to claim 14 that connects the power supply and the supply source, and the discharge lamp.

18. An exposure apparatus that exposes a pattern on a photosensitive substrate using exposure light that is generated from a light source apparatus, wherein the exposure apparatus uses the light source apparatus according to claim 17 as the light source apparatus.

* * * * *